US011716570B2

(12) United States Patent
Nakashima et al.

(10) Patent No.: US 11,716,570 B2
(45) Date of Patent: Aug. 1, 2023

(54) SPEAKER DIAPHRAGM AND METHOD OF PRODUCING SPEAKER DIAPHRAGM

(71) Applicant: Yamaha Corporation, Hamamatsu (JP)

(72) Inventors: Hiroshi Nakashima, Hamamatsu (JP); Tsunenori Sano, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 30 days.

(21) Appl. No.: 17/394,660

(22) Filed: Aug. 5, 2021

(65) Prior Publication Data

US 2021/0368270 A1 Nov. 25, 2021

Related U.S. Application Data

(63) Continuation of application No. PCT/JP2020/003228, filed on Jan. 29, 2020.

(30) Foreign Application Priority Data

Feb. 6, 2019 (JP) ..... 2019-019300

(51) Int. Cl.

| | |
|---|---|
| ***H04R 7/12*** | (2006.01) |
| ***H04R 1/28*** | (2006.01) |
| ***H04R 31/00*** | (2006.01) |

(52) U.S. Cl.

CPC ..... *H04R 7/12* (2013.01); *H04R 1/2834* (2013.01); *H04R 31/003* (2013.01)

(58) Field of Classification Search

CPC ..... H04R 7/12; H04R 1/2834; H04R 31/003

See application file for complete search history.

(56) References Cited

FOREIGN PATENT DOCUMENTS

| | | | | | |
|---|---|---|---|---|---|
| JP | 10-13988 | A | | 1/1998 | |
| JP | 2016-82442 | A | | 5/2016 | |
| JP | 2017-173713 | A | | 9/2017 | |
| WO | WO 2014/162412 | A1 | | 10/2014 | |
| WO | WO-2014162412 | A1 | * | 10/2014 | ..... H04R 7/125 |
| WO | WO-2019087834 | A1 | * | 5/2019 | ..... B32B 29/02 |

OTHER PUBLICATIONS

Japanese-language Office Action issued in Japanese Application No. 2019-019300 dated Oct. 3, 2022 with English translation (five (5) pages).

Japanese-language Office Action issued in Japanese Application No. 2019-019300 dated Mar. 20, 2023, with English translation (eight (8) pages).

* cited by examiner

*Primary Examiner* — Sunita Joshi

(74) *Attorney, Agent, or Firm* — Crowell & Moring LLP

(57) ABSTRACT

A speaker diaphragm includes a first lamination region and a second lamination region. In the first lamination region, a plurality of layers are laminated in a thickness direction of the speaker diaphragm. In the second lamination region, a plurality of layers different in number from the plurality of layers in the first lamination region are laminated. The second lamination region is different from first lamination region in average density.

15 Claims, 6 Drawing Sheets

SPEAKER DIAPHRAGM AND METHOD OF PRODUCING SPEAKER DIAPHRAGM

CROSS-REFERENCE TO RELATED APPLICATIONS

The present application is a continuation application of International Application No. PCT/JP2020/003228, filed Jan. 29, 2020, which claims priority to Japanese Patent Application No. 2019-019300, filed Feb. 6, 2019. The contents of these applications are incorporated herein by reference in their entirety.

BACKGROUND

Field

The present disclosure relates to a speaker diaphragm and a method of producing a speaker diaphragm.

Background Art

In order for a speaker diaphragm to efficiently generate sound, it is desired that the rigidity of the speaker diaphragm is adjustable in accordance with a desired frequency band ranging from a low frequency to a high frequency.

JP11-75290A discloses a speaker diaphragm adjustable to a desired rigidity. This speaker diaphragm contains a predetermined amount of fillers such as an inorganic filler and a fiber-based filler in a resin matrix made of ultra-high crystalline polypropylene.

JP11-75290A recites that the rigidity of the speaker diaphragm can be adjusted by adjusting the types and content ratios of the fillers dispersed in the resin matrix. Thus, the speaker diaphragm recited in JP11-75290A is designed to enhance its acoustic characteristics in a specific frequency band.

SUMMARY

One aspect is a speaker diaphragm that includes a first lamination region and a second lamination region. In the first lamination region, a plurality of layers are laminated in a thickness direction of the speaker diaphragm. In the second lamination region, a plurality of layers different in number from the plurality of layers in the first lamination region are laminated. The second lamination region is different from first lamination region in average density.

Another aspect is a method of producing a speaker diaphragm. The method includes forming a lamination body including a plurality of lamination regions adjacent to each other. Each of the plurality of lamination regions is formed by laminating a plurality of layers. The method also includes hot-pressing the lamination body to form the lamination body into a cone shape having a substantially uniform thickness. The plurality of lamination regions are different from each other in average density.

BRIEF DESCRIPTION OF THE DRAWINGS

A more complete appreciation of the present development and many of the attendant advantages thereof will be readily obtained as the same becomes better understood by reference to the following detailed description when considered in connection with the following figures.

DESCRIPTION OF THE EMBODIMENTS

Figure 1:
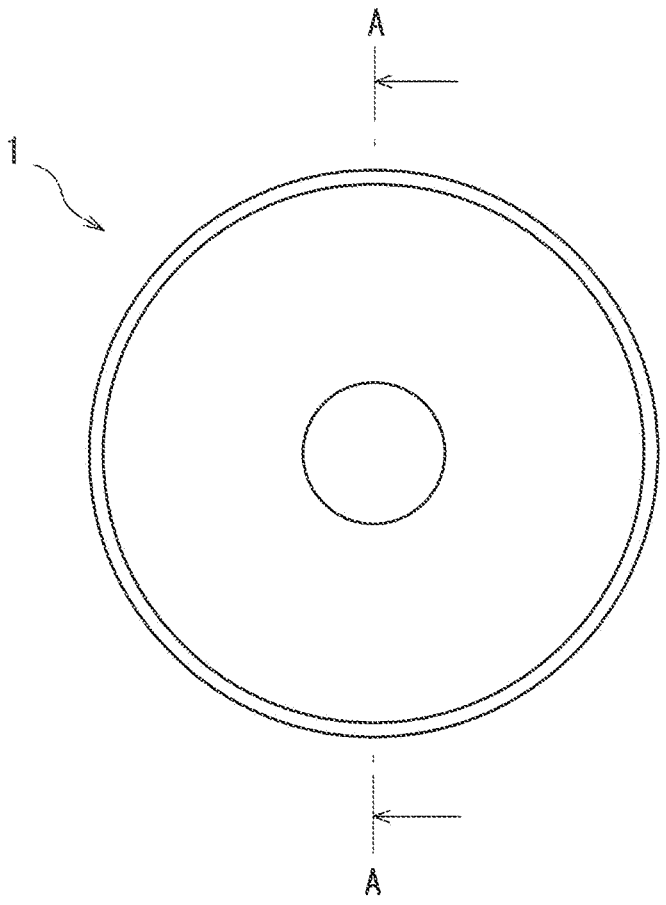
FIG. 1 is a schematic front view of a speaker diaphragm according to an embodiment of the present development.

The present development is applicable to a speaker diaphragm and a method of producing a speaker diaphragm.

The embodiments will now be described with reference to the accompanying drawings, wherein like reference numerals designate corresponding or identical elements throughout the various drawing.

First Embodiment

Speaker Diaphragm

Figure 2:
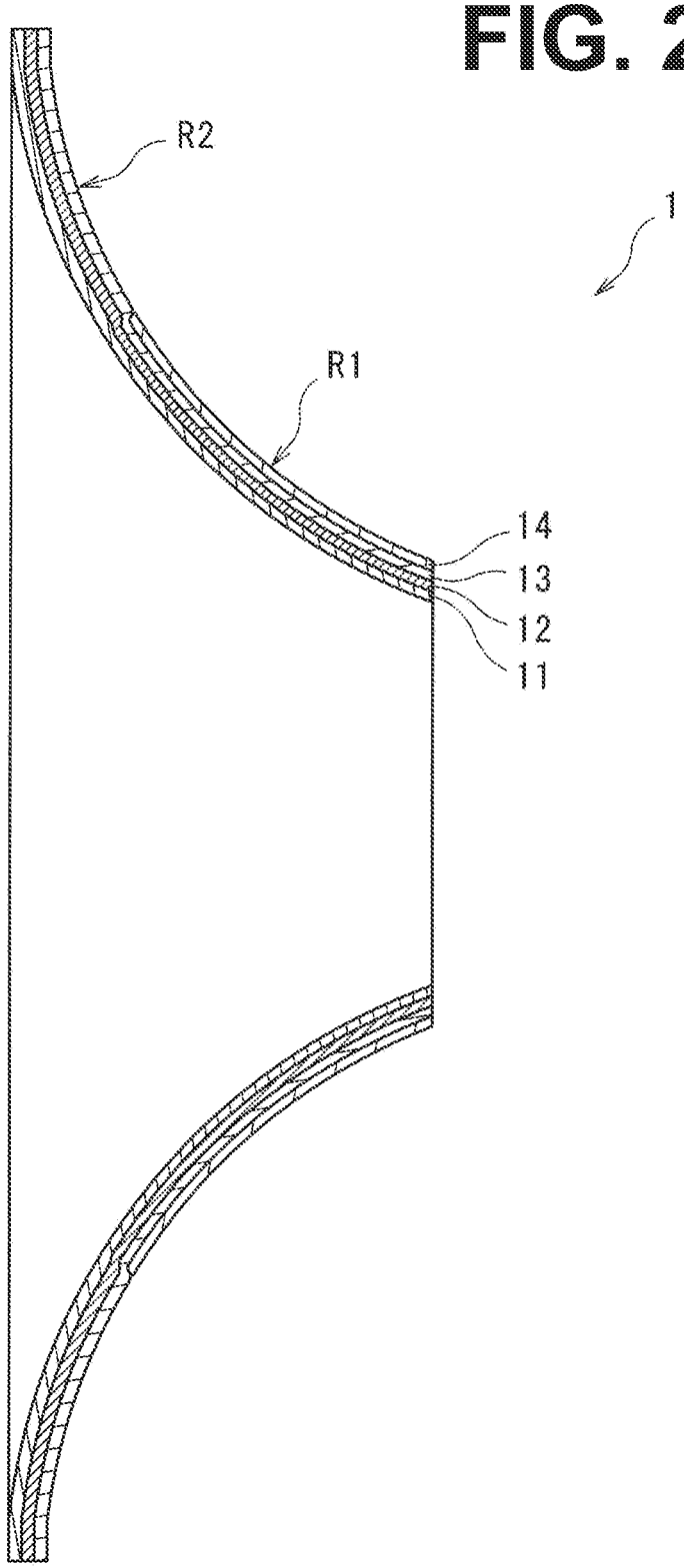
FIG. 2 is a schematic cross-sectional view of the speaker diaphragm cut along a plane indicated by the line A-A illustrated in FIG. 1.
Figure 3:
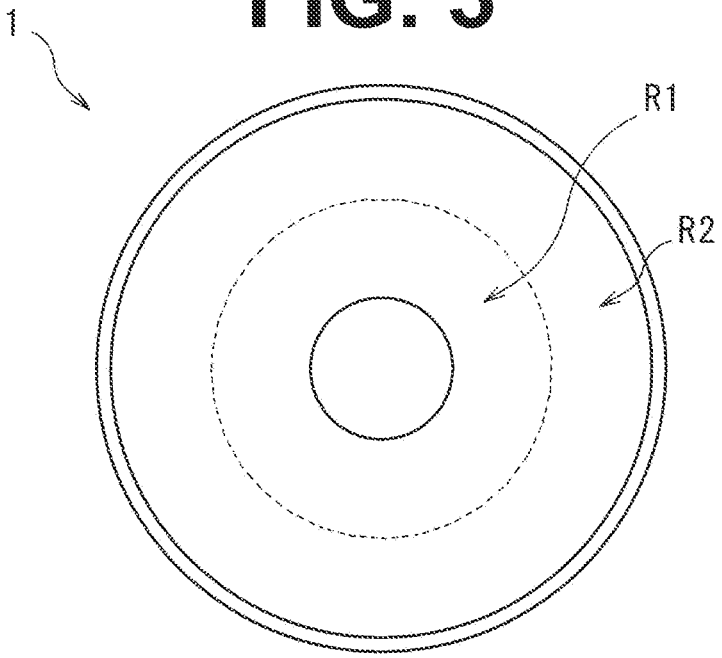
FIG. 3 is a schematic front view of the speaker diaphragm illustrating a boundary between a first lamination region and a second lamination region of the speaker diaphragm illustrated in FIG. 1.

A speaker diaphragm 1 illustrated in FIGS. 1 to 3 includes a plurality of layers laminated in a thickness direction of the speaker diaphragm 1.

The speaker diaphragm 1 includes two or more lamination regions different from each other in the number of the plurality of laminated layers. The plurality of lamination regions are continuously aligned in a plane direction of the speaker diaphragm 1. In the speaker diaphragm 1, the lamination regions, which are different from each other in the number of the laminated layers, are different from each other in average density. The plurality of layers range from the front surface (outer surface on the sound emission side) of the speaker diaphragm 1 to the back surface (outer surface on the electric signal reception side) of the speaker diaphragm 1. (That is, the front surface of the foremost layer among the plurality of layers constitutes the front surface (inner surface) of the speaker diaphragm 1, and the back surface of the rearmost layer among the plurality of layers constitutes the back surface (outer surface) of the speaker diaphragm 1.) The speaker diaphragm 1 may be used for a small-sized speaker provided in devices such as a headphone, an earphone, and a portable electronic device.

The speaker diaphragm 1 vibrates in response to an electrical signal. The speaker diaphragm 1 can be formed into a shape corresponding to the speaker in which the speaker diaphragm 1 is used. In FIGS. 1 to 3, the speaker diaphragm 1 has a cone shape (more specifically, a truncated cone shape with an open bottom). The size of the speaker diaphragm 1 can be set according to the speaker in which the speaker diaphragm 1 is used.

As illustrated in FIGS. 2 and 3, the speaker diaphragm 1 includes a first lamination region R1 and a second lamination region R2. The first lamination region R1 has a first number of layers. The second lamination region R2 is adjacent to the first lamination region R1, is disposed on the radially outer side of the first lamination region R1, and has a second number of layers different from the first number of layers. In the speaker diaphragm 1, the number of layers varies depending on the lamination region, which is different from the other lamination region in average density. Specifically, the speaker diaphragm 1 includes: the first lamination region R1, which has a first average density; and the second lamination region R2, which is adjacent to the first lamination region R1, is disposed on the radially outer side of the first lamination region R1, and has a second average density different from the first average density. The speaker diaphragm 1 is made up of two lamination regions, namely, the first lamination region R1 and the second lamination region R2. In the speaker diaphragm 1, different average densities respectively correspond to lamination regions having different numbers of laminated layers (that is, a lamination region having a unique number of laminated layers and a region having a unique average density correspond to each other on a one to-one basis). This configuration makes the average density in the plane direction easily adjustable, that is, makes the rigidity of the speaker diaphragm 1 in the plane direction easily adjustable. Further, as will be described later, the speaker diaphragm 1 can be fixed in a compressed state such that the thickness of either the first lamination region R1 or the second lamination region R2 that is larger in the number of the laminated layers is made to match the thickness of either the first lamination region R1 or the second lamination region R2 that is smaller in the number of the laminated layers. This configuration ensures that the speaker diaphragm 1 has an increased difference in thickness-direction compressibility between the first lamination region R1 and the second lamination region R2. This, in turn, ensures that in the speaker diaphragm 1, the difference in average density between the first lamination region R1 and the second lamination region R2 is increased. This enables the speaker diaphragm 1 to effectively generate: a sound in a frequency band in the first lamination region R1; and a sound in a different frequency band in the second lamination region R2. Thus, while the lamination regions different from each other in the number of the laminated layers have substantially the same thickness, the lamination regions have different numbers of laminated layers included in the lamination regions. This configuration makes the rigidity clearly varied between the lamination regions such that the lamination region having a larger number of laminated layers has a larger degree of rigidity. As used herein, the term "average density" of each lamination region means the average of densities of all the plurality of layers in each lamination region. For example, the average density can be obtained by: cutting a 5 mm-by-10 mm rectangular piece out of each lamination region in the plane direction; and dividing the weight of the rectangular piece by the volume of the rectangular piece. In obtaining the volume of the rectangular piece, it is possible to obtain the thickness of the rectangular piece by obtaining the average of thicknesses of the rectangular piece at arbitrary five points.

It is preferable that both the front and back surfaces of the speaker diaphragm 1 are flush with each other at the boundary between the two lamination regions (that is, the boundary between the first lamination region R1 and the second lamination region R2). This configuration of the speaker diaphragm 1 makes it easy to, while eliminating or minimizing the influence caused by the formation of a step between the first lamination region R1 and the second lamination region R2, increase the difference in average density between the first lamination region R1 and the second lamination region R2 by increasing the difference in thickness-direction compressibility between the first lamination region R1 and the second lamination region R2. As a result, the speaker diaphragm 1 is likely to more effectively generate: a sound in a frequency band in the first lamination region R1; and a sound in a different frequency band in the second lamination region R2. As used herein, the expression "both the front and back surfaces of the speaker diaphragm 1 are flush with each other (or there is no step) at the boundary between the two lamination regions" means that the two lamination regions are continuous in the plane direction and the ratio of the thickness of the edge of one lamination region to the edge of the other lamination region adjacent to each other is 0.90 or more and 1.10 or less, preferably 0.95 or more and 1.05 or less, and more preferably 0.97 or more and 1.03 or less. It is to be noted that the boundary between the first lamination region R1 and the second lamination region R2 is located approximately at the center of the speaker diaphragm 1 in its radial direction (vertical direction in FIG. 2).

The thickness of the first lamination region R1 and the second lamination region R2 is preferably uniform. This thickness, which is the thickness of the speaker diaphragm 1, may be 0.4 mm or more and 1.0 mm or less, for example. This configuration of the speaker diaphragm 1 makes it easy to increase the difference in average density between the first lamination region R1 and the second lamination region R2 by increasing the difference in thickness-direction compressibility between the first lamination region R1 and the second lamination region R2. The upper limit of the ratio of the difference between the average thickness of the first lamination region R1 and the average thickness of the second lamination region R2 to the average thickness of the lamination region larger in the number of the layers among the first lamination region R1 and the second lamination region R2 is preferably 0.10, more preferably 0.05, and still more preferably 0.01. If the ratio of the difference exceeds the upper limit, it may be difficult to sufficiently increase the difference in average density between the first lamination region R1 and the second lamination region R2. As used herein, the term "average thickness" refers to average of thicknesses at arbitrary five points on each lamination region.

Description will be made with regard to each layer of the first lamination region R1 and the second lamination region R2.

First Lamination Region

As illustrated in FIG. 2, in the present embodiment, the first lamination region R1 has a four-layer structure. The first lamination region R1 includes the inner circumferential edge (the right end in FIG. 2) of the speaker diaphragm 1. The average density of the first lamination region R1 is larger than the average density of the second lamination region R2 (that is, the above-described first average density is larger than the above-described second average density). Also, the number of the layers in the first lamination region R1 is larger than the number of the layers in the second lamination region R2 (that is, the above-described first number of layers is larger than the above-described second number of layers). That is, in the speaker diaphragm 1, the lamination region larger in average density is larger in the number of laminated layers than the lamination region smaller in average density. In the speaker diaphragm 1, the first lamination region R1, which is larger in the number of laminated layers, and the second lamination region R2, which is smaller in the number of laminated layers, are different from each other in thickness-direction compressibility. In the speaker diaphragm 1, based on this compressibility difference, the average density of the first lamination region R1 is larger than the average density of the second lamination region R2. In the speaker diaphragm 1, the average density of the lamination region larger in the number of laminated layers is larger than the average density of the lamination region smaller in the number of laminated layers. This configuration makes it easy to increase the difference in rigidity between the lamination regions. Also, generally, when a speaker diaphragm is incorporated in a speaker, the neck of the speaker diaphragm (the end of the speaker diaphragm on its inner circumferential edge side) receives the largest amount of load. In this regard, the speaker diaphragm 1 is such that the average density of the first lamination region R1 is larger than the average density of the second lamination region R2. This configuration ensures that the rigidity of the neck is increased. As a result, the speaker diaphragm 1 ensures that by increasing the strength of the neck, the layers are prevented from being peeled off or damaged. The speaker diaphragm 1 also ensures that by increasing the rigidity of the neck, the transfer characteristics in the high frequency range are enhanced. That is, in the speaker diaphragm 1, since the average density of the first lamination region R1 is larger than the average density of the second lamination region R2, both durability and acoustic characteristics are enhanced.

The first lamination region R1 includes a first solid layer 11, a first microporous layer 12, a second solid layer 13, and a second microporous layer 14 in this order from the front side to the back side of the first lamination region R1. Each of the first solid layer 11, the first porous layer 12, the second solid layer 13, and the second porous layer 14 is preferably a chemical fiber-mixed paper layer containing a plurality of thermally fused thermoplastic resin fibers. In other words, each layer of the speaker diaphragm 1 is preferably a chemical fiber-mixed paper layer. The configuration in which each layer of the speaker diaphragm 1 is a chemical fiber-mixed paper layer makes it easy to reduce the weight of the speaker diaphragm 1. This configuration also prevents a step from being formed between the first lamination region R1 and the second lamination region R2 in a hot-pressing process, described later. This, in turn, makes it easy to make the front and back surfaces of the speaker diaphragm 1 flush with each other at the boundary between the first lamination region R1 and the second lamination region R2. As a result, the speaker diaphragm 1 makes it easy to increase the difference in average density between the first lamination region R1 and the second lamination region R2. Further, the above configuration smoothens the boundary between the first lamination region R1 and the second lamination region R2, and smoothens the vicinity of the boundary. This ensures that desired acoustic characteristics are easily obtained.

As illustrated in FIG. 3, the first lamination region R1 has an annular shape. Specifically, the first lamination region R1 has an annular shape whose inner circumferential edge coincides with the inner circumferential edge of the speaker diaphragm 1. In the speaker diaphragm 1, since the first lamination region R1 has an annular shape, the strength of the neck of the speaker diaphragm 1 is uniformly increased throughout its circumference. As a result, each layer is easily and reliably prevented from being peeled off or damaged in any other manner. The above configuration also ensures that the transfer characteristics in high frequency ranges are uniformly enhanced throughout the circumference of the speaker diaphragm 1. As used herein, the term "annular" refers to an endless shape defined by an inner circumferential edge and an outer circumferential edge.

First Solid Layer

The first solid layer 11 contains a resin matrix and fibers dispersed in the resin matrix. The first solid layer 11 is mainly for improving the rigidity of the speaker diaphragm 1 and imparting water resistance to the speaker diaphragm 1. The average thickness of the first solid layer 11 may be 5 μm or more and 500 μm or less, for example.

The resin matrix constituting the first solid layer 11 may be any resin matrix formable into a desired shape with fibers dispersed in the resin matrix. A preferable example is a thermoplastic resin formable by hot-pressing. Examples of the thermoplastic resin that can be used include polyolefins such as polyethylene and polypropylene. Also, the thermoplastic resin to be used preferably has a melting point of 100° C. (degrees Celsius) or higher and 180° C. (degrees Celsius) or lower, in view of formability in hot-pressing.

The resin matrix is preferably formed by fusing a plurality of thermoplastic resin fibers together, as described above. A preferable example of such thermoplastic resin fiber is a synthetic pulp product available on the market under the tradename SWP. It is to be noted that the thermoplastic resin fibers are melted into a matrix resin by heating and pressing, described later, and thus the thermoplastic resin fibers do not exist as fibers in the speaker diaphragm 1.

Examples of the fiber contained in the first solid layer 11 include wood pulp and high-rigidity fiber. Either wood pulp or high-rigidity fiber can be used alone, or a mixture of wood pulp and high-rigidity fiber can be used.

Examples of the wood pulp include: chemical pulps such as leaf (hardwood) bleached kraft pulp (LBKP), needle (softwood) bleached kraft pulp (NBKP), leaf (hardwood) unbleached kraft pulp (LUKP), leaf (hardwood) semi-bleached kraft pulp (LSBKP), leaf (hardwood) sulfite pulp, and needle (softwood) sulfite pulp; mechanical pulps such as stone groundwood pulp (SGP), pressure groundwood (PGW) pulp, refiner groundwood pulp (RGP), thermo-mechanical pulp (TMP), chemigroundwood pulp (CGP), and groundwood pulp (GP); and pulps produced from various types of recovered paper such as disintegrated recovered paper pulp, disintegrated and deinked recovered paper pulp, disintegrated, deinked, and bleached recovered paper pulp.

Examples of the high-rigidity fiber include polyparaphenylene benzobisoxazole fiber, polyparaphenylene terephthalamide fiber, and carbon fiber. These fibers can be used alone or in a combination of any two or more of the fibers, as deemed convenient. Among these fibers, polyparaphenylene benzobisoxazole fiber is preferable for its high rigidity.

First Porous Layer

The first porous layer 12 has a large number of pores, and has a resin matrix and fibers dispersed in the resin matrix. The first porous layer 12 is mainly for improving the rigidity of the speaker diaphragm 1. Also, the presence of pores makes vibration-caused stress concentrate to the first porous layer 12 while a vibration occurs, where the energy of the vibration is converted into heat, with the result that the vibration is attenuated. The average thickness of the first porous layer 12 may be for example, 50 μm or more and 500 μm or less.

As the resin matrix constituting the first porous layer 12, it is possible to use the same resin matrix as the resin matrix constituting the first solid layer 11.

As the fibers contained in the first porous layer 12, it is possible to use the same fibers as the fibers contained in the first solid layer 11.

The pores preferably include closed cells so as to suppress a decrease in the rigidity of the first porous layer 12. Such pores can be formed using, for example, hollow microbeads or thermally expandable microcapsules.

The average diameter of the pores may be, for example, 20 μm or more and 100 μm or less. Also, the porosity of the first porous layer 12 may be, for example, 30% or more and 80% or less. As used herein, the term "porosity" means a value calculated as an area ratio of the pores in a cross-section in the thickness direction of the first porous layer 12.

Second Solid Layer

The second solid layer 13 includes a resin matrix and fibers dispersed in the resin matrix. The second solid layer 13 is mainly for improving the rigidity of the speaker diaphragm 1. The second solid layer 13 may have a specific configuration identical or similar to the specific configuration of the first solid layer 11.

Second Porous Layer

The second porous layer 14 has a large number of pores and has a resin matrix and fibers dispersed in the resin matrix. The second porous layer 14 is mainly for improving the rigidity of the speaker diaphragm 1. Also, the presence of pores makes vibration-caused stress concentrate to the second porous layer 14 while a vibration occurs, where the energy of the vibration is converted into heat, with the result that the vibration is attenuated. The second porous layer 14 may have a specific configuration identical or similar to the specific configuration of the first porous layer 12.

Second Lamination Region

As illustrated in FIG. 2, in the present embodiment, the second lamination region R2 has a three-layer structure. The second lamination region R2 includes the first solid layer 11, the first porous layer 12, and the second solid layer 13 in this order from the front side to the back side of the speaker diaphragm 1. That is, the second lamination region R2 has such a configuration that lacks one or some of the layers of the layer structure of the first lamination region R1. Specifically, in the present embodiment, the second lamination region R2 lacks the second microporous layer 14, which is the rearmost layer of the first lamination region R1. More specifically, the first solid layer 11, the first porous layer 12, and the second solid layer 13 in the first lamination region R1 extend to the outer circumferential edge of the speaker diaphragm 1 to form the second lamination region R2. The difference in average thickness between the first lamination region R1 and the second lamination region R2 is smaller than the average thickness of the second porous layer 14 (which is the layer included only in the first lamination region R1). Each of the layers (the first solid layer 11, the first porous layer 12, and the second solid layer 13) constituting the second lamination region R2 is preferably a chemical fiber-mixed paper layer containing a plurality of thermally fused thermoplastic-resin fibers, similarly to the first lamination region R1.

The second lamination region R2 includes the outer circumferential edge (the left end in FIG. 2) of the speaker diaphragm 1. More specifically, the second lamination region R2 is formed throughout the outer circumferential edge of the speaker diaphragm 1. In the speaker diaphragm 1, the second lamination region R2, which is smaller in the number of layers than the first lamination region R1, is formed throughout the outer circumferential edge of the speaker diaphragm 1. In contrast, an edge member (not illustrated) connected to the outer circumferential edge of the speaker diaphragm 1 is made of a material lower in rigidity than a general speaker diaphragm, as described later. Examples of such material include polyurethane or elastomer. Under the circumstances, the speaker diaphragm 1 makes it easy to reduce the difference in rigidity between the edge member and the outer circumferential edge of the speaker diaphragm 1 or to obtain a uniform rigidity throughout the edge member and the outer circumferential edge. This, in turn, eliminates or minimizes resonance between the speaker diaphragm 1 and the edge member, ensuring that desired acoustic characteristics are easily obtained.

In the speaker diaphragm 1, the number of the layers gradually decreases from the inner side toward the outer side in the radial direction of the speaker diaphragm 1. That is, in the speaker diaphragm 1, the average density gradually decreases (monotonically decreases in a stepwise manner) from the inner side toward the outer side in the radial direction of the speaker diaphragm 1. This configuration ensures that in the speaker diaphragm 1, the neck is strengthened by the first lamination region R1, which is larger in average density, and the transfer characteristics in the high frequency range are improved. At the same time, resonance between the speaker diaphragm 1 and the edge member is eliminated or minimized by the second lamination region R2, which is smaller in average density, with the result that the acoustic characteristics in the low frequency range are easily improved.

As illustrated in FIG. 3, the first lamination region R1 and the second lamination region R2 are concentric regions. The configuration in which the first lamination region R1 and the second lamination region R2 are concentric regions enables the speaker diaphragm 1 to easily and reliably generate sounds in a plurality of different frequency bands. More specifically, the speaker diaphragm 1 is capable of generating: a high-frequency sound in the first lamination region R1, which is larger in average density; and a low-frequency sound in the second lamination region R2, which is smaller in average density than the first lamination region R1. Further, in the speaker diaphragm 1, the first lamination region R1 is formed throughout the inner circumferential edge of the speaker diaphragm 1, and the second lamination region R2 is formed throughout the outer circumferential edge of the speaker diaphragm 1. This configuration ensures that the rigidity of the speaker diaphragm 1 is gradually decreased radially from the inner side toward the outer side in the radial direction of the speaker diaphragm 1. This, in turn, ensures that the transfer characteristics in the high frequency range and the acoustic characteristics in the low frequency range are easily and reliably enhanced at the same time.

Method of Producing Speaker Diaphragm

Next, a method of producing the speaker diaphragm 1 illustrated in FIG. 1 will be described. By this speaker-diaphragm producing method, the speaker diaphragm 1 is produced, in which a plurality of layers are laminated in the thickness direction of the speaker diaphragm 1. The speaker-diaphragm producing method includes a step (forming step) of forming two or more lamination regions different from each other in average density and in the number of laminated layers. The forming step includes, for example: a step of wet-forming a paper-making body corresponding to each layer (the first solid layer 11, the first porous layer 12, the second solid layer 13, and the second porous layer 14) of the speaker diaphragm 1 (paper-making step); a step of laminating the paper-making bodies formed in the paper-making step (laminating step); a step of drying the lamination body formed in the laminating step (drying step); and a step of hot-pressing the lamination body dried in the drying step (hot-pressing step). In this speaker-diaphragm producing method, two or more lamination regions different from each other in a number of the laminated layers are formed in the laminating step. In the present embodiment, the following lamination regions are formed in the laminating step: a lamination region having a first number of laminated layers (which is the lamination region corresponding to the first lamination region R1); and a lamination region having a second number of laminated layers (which is the lamination region corresponding to the second lamination region R2).

Paper-Making Step

In the paper-making step, materials for forming the first solid layer 11, the first porous layer 12, the second solid layer 13, and the second porous layer 14 are dispersed in a dispersion medium. This dispersion medium is made into paper using a paper-making mold having a shape corresponding to the speaker diaphragm 1. Thus, a paper-making body corresponding to each layer is formed. It is preferable that the material of each paper-making body preferably contains the thermoplastic resin fibers constituting the resin matrix and the fiber.

In order to form pores in the first porous layer 12 and the second porous layer 14, the materials of the first porous layer 12 and the second porous layer 14 preferably contain, for example, a chemical foaming agent, thermally expandable microcapsules, and hollow beads.

As the dispersion medium of the slurry, it is possible to use an aqueous dispersion medium such as water, a methanol aqueous solution, and an ethanol aqueous solution. The solid content of the slurry may be, for example, 0.1% by mass or more and 10% by mass or less.

The paper-making mold used for forming the paper-making bodies in the paper-making step may be any mold that has a shape corresponding to the speaker diaphragm 1, that captures the material of each layer, and that allows the dispersion medium to pass through the mold. Examples of such paper-making mold include a metal mesh and a punching metal.

Laminating Step

In the laminating step, the paper-making bodies respectively corresponding to the first solid layer 11, the first porous layer 12, the second solid layer 13, and the second porous layer 14 are laminated in this order. In the laminating step, the paper-making bodies can be laminated by sequentially laminating and discharging the paper-making bodies from the paper-making mold used in the paper-making step. It is to be noted, however, that the second porous-layer 14 is not laminated at the portion corresponding to the second lamination region R2. That is, predetermined layers are laminated on the portions respectively corresponding to the lamination regions R1 and R2. This also applies to the embodiments described later.

Drying Step

In the drying step, the solvent remaining in each paper-making body laminated in the laminating step is volatilized. While there is no particular limitation to the method of drying the paper-making body, it is possible to use an oven. The temperature of the oven may be, for example, 60° C. (degrees Celsius). or higher and 90° C. (degrees Celsius) or lower. The drying time may be, for example, 5 minutes or more and 3 hours or less. It is to be noted that the drying step may be performed before the laminating step. Specifically, it is possible to: dry each of the paper-making bodies independently; then laminate the paper-making bodies; and then subject the laminated paper-making bodies to the subsequent hot-pressing step.

Hot-Pressing Step

In the hot-pressing step, two or more lamination regions different from each other in average density are formed in the lamination body after the drying step. In the hot-pressing step, the lamination body after the drying step is placed in a pair of press molds having a copy mold of the speaker diaphragm 1. Then, the lamination body is heated and pressed in the pair of press molds. As a result, for example, the thermoplastic resin fibers contained in the paper-making bodies are melted to form resin matrices of the first solid layer 11, the first porous layer 12, the second solid layer 13, and the second porous layer 14. Then, layers that are among the first solid layer 11, the first porous layer 12, the second solid layer 13, and the second porous layer 14 and that are adjacent to each other are attached to each other. In the hot-pressing step, a difference in compressibility is made between at least two lamination regions that are different from each other in the number of laminated layers (specifically, the lamination region corresponding to the first lamination region R1 and the lamination region corresponding to the second lamination region R2). By making the difference in compressibility, a difference in average density is made between these lamination regions. In the hot-pressing step, it is preferable to: suppress the formation of a step between the lamination regions respectively corresponding to the first lamination region R1 and the second lamination region R2; and smoothly form the boundary between the lamination regions respectively corresponding to the first lamination region R1 and the second lamination region R2 and smoothly form the boundary. That is, in the hot-pressing step, it is preferable to make the first lamination region R1 and the second lamination region R2 flush with each other at their boundary on the front and back surfaces of the speaker diaphragm 1. Thus, the speaker-diaphragm producing method ensures that the difference in compressibility between the first lamination region R1 and the second lamination region R2 is increased, so that the difference in average density between the first lamination region R1 and the second lamination region R2 is increased. In this hot-pressing step, the first lamination region R1 and the second lamination region R2 are pressed to the same thickness. This makes the first solid layer 11, the first microporous layer 12, and the second solid layer 13 in the first lamination region R1 thinner than the first solid layer 11, the first microporous layer 12, and the second solid layer 13 in the second lamination region R2.

In a case where the materials of the first porous layer 12 and the second porous layer 14 include, for example, a foaming agent and thermal expansion microcapsules, these contents are foamed or expanded in the hot-pressing step to form pores in the first porous layer 12 and the second porous layer 14.

In the speaker-diaphragm producing method, the total thickness of the first solid layer 11, the first porous layer 12, the second solid layer 13 and the second porous layer 14 is controllable at a uniform thickness by performing the hot-pressing step. As a result, the speaker-diaphragm producing method ensures that the difference in average density between the first lamination region R1 and the second lamination region R2 is increased, resulting in enhanced acoustic characteristics.

In the hot-pressing step, in order to set the thickness of the speaker diaphragm 1 to a desired thickness, it is possible to, for example, provide a spacer between the pair of press molds to determine the gap between the pair of press molds in the hot-pressing step.

The heating temperature in the hot-pressing step is equal to or higher than the melting point of the resin matrix, an example being a temperature higher than the melting point of the resin matrix by 5° C. (degrees Celsius) or higher and 20° C. (degrees Celsius) or lower. Also, the heating time in the hot-pressing step may be, for example, 10 seconds or more and 60 seconds or less.

In the speaker-diaphragm producing method, after the hot-pressing step, the press molds may be cooled in a pressurized state to cure the resin matrix, and then the obtained speaker diaphragm 1 may be taken out of the press molds.

Advantages

The speaker diaphragm 1 includes two or more lamination regions different from each other in the number of laminated layers, and the lamination regions are different from each other in average density. This configuration ensures that the rigidity of the lamination region smaller in average density is made smaller than the rigidity of the lamination region larger in average density. This configuration enables the speaker diaphragm 1 to effectively generate: a sound in a frequency band in the lamination region smaller in average density; and a sound in a different frequency band in the lamination region larger in average density.

In the speaker diaphragm 1, all the layers (the first solid layer 11, the first porous layer 12, the second solid layer 13, and the second porous layer 14) constituting the speaker diaphragm 1 include a resin matrix and fibers dispersed in the resin matrix. This configuration ensures that the thickness of the speaker diaphragm 1 is controllable to a uniform thickness in the above-described hot-pressing step. This, as a result, enables the speaker diaphragm 1 to control its acoustic characteristics appropriately. Also, the speaker diaphragm 1 includes the first porous layer 12 and the second porous layer 14. This configuration promotes a reduction in weight of the speaker diaphragm 1.

In the speaker diaphragm 1, the solid layers (the first solid layer 11 and the second solid layer 13) reinforced by fibers and having relatively high rigidity and the porous layers (the first porous layer 12 and the second porous layer 14) having pores and having a relatively high vibration attenuation rate are alternately laminated. That is, layers different from each other in elastic modulus are alternately laminated. This configuration ensures that shear strain concentrates to the first porous layer 12 and the second porous layer 14, resulting in increased internal loss. In addition, since the outermost layer on the front surface side of the speaker diaphragm 1 is a solid layer, the speaker diaphragm 1 has high resistance to water wetting.

By the speaker-diaphragm producing method, the speaker diaphragm 1, which is capable of effectively generating sounds in different frequency bands with a single diaphragm, is produced easily and reliably.

Second Embodiment

Speaker Diaphragm Unit

Figure 4:
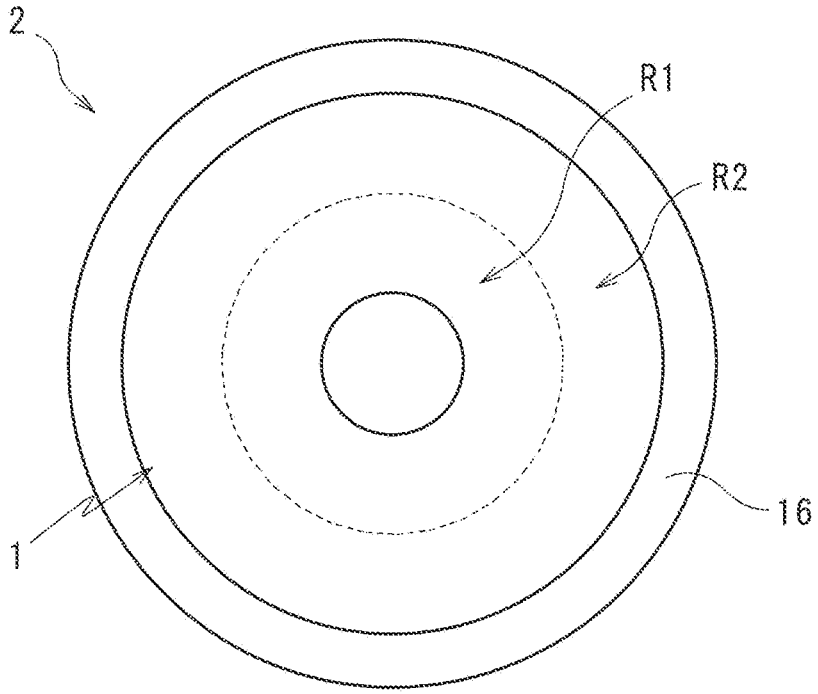
FIG. 4 is a schematic front view of a speaker diaphragm unit including the speaker diaphragm illustrated in FIG. 1.

A speaker diaphragm unit 2 illustrated in FIG. 4 includes the speaker diaphragm 1 illustrated in FIG. 1 and an edge member 16, which is disposed at the outer circumferential edge of the speaker diaphragm 1.

The edge member 16 is disc-shaped. The inner circumferential edge of the edge member 16 is attached to the surface of the outer circumferential edge of the speaker diaphragm 1. The edge member 16 may have a portion such as an annular raised portion raised on the surface side. The main component of the edge member 16 is preferably lightweight and excellent in followability, examples including synthetic resins such as polyurethane and elastomers. As used herein, the term "main component" refers to a component having the largest content in terms of mass.

Advantages

In the speaker diaphragm unit 2, the second lamination region R2, which is smaller in average density than the first lamination region R1, is formed throughout the circumference of the outer circumferential edge of the speaker diaphragm 1. This configuration makes it easy to uniformize the rigidity of the speaker diaphragm 1 and the rigidity of the edge member 16. This, in turn, eliminates or minimizes resonance between the speaker diaphragm unit 2 and the edge member 16, ensuring that desired acoustic characteristics are easily obtained.

Figure 5:
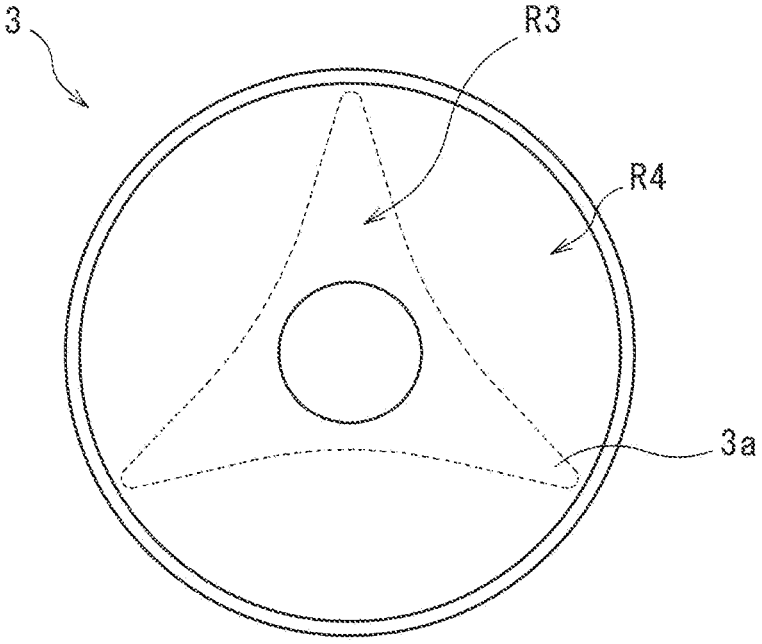
FIG. 5 is a schematic front view of a speaker diaphragm according to an embodiment different from the speaker diaphragm illustrated in FIG. 1.

In a speaker diaphragm 3 illustrated in FIG. 5, a plurality of layers are laminated in the thickness direction of the speaker diaphragm 3.

The speaker diaphragm 3 includes two or more lamination regions different from each other in the number of laminated layers. The plurality of lamination regions are continuously aligned in the plane direction of the speaker diaphragm 3. In the speaker diaphragm 3, the lamination regions are different from each other in average density. The plurality of layers are provided from the front surface to the back surface of the speaker diaphragm 3. It is to be noted that the speaker diaphragm 3 may be used for a small-size speaker provided in such devices as a headphone, an earphone, and a portable electronic device.

The speaker diaphragm 3 vibrates in response to an electrical signal. The speaker diaphragm 3 can be formed into a shape corresponding to the speaker in which the speaker diaphragm 1 is used. In FIG. 5, the speaker diaphragm 3 has a cone shape (more specifically, a truncated cone shape). The size of the speaker diaphragm 3 can be set according to the speaker in which the speaker diaphragm 1 is used.

The speaker diaphragm 3 includes a first lamination region R3 and a second lamination region R4. The first lamination region R3 has a first number of layers. The second lamination region R4 is adjacent to the first lamination region R3, is disposed on the radially outer side of the first lamination region R3, and has a second number of layers different from the first number of layers. In the speaker diaphragm 3, the lamination regions, which are different from each other in average density, are different from each other in the number of laminated layers. Specifically, the speaker diaphragm 3 includes: the first lamination region R3, which has a first average density; and the second lamination region R4, which is adjacent to the first lamination region R3 on the radially outer side of the first lamination region R3, and has a second average density different from the first average density. The speaker diaphragm 3 is made up of two lamination regions, namely, the first lamination region R3 and the second lamination region R4. The speaker diaphragm 3, the lamination region larger in average density is larger in the number of laminated layers than the lamination region smaller in average density. In the speaker diaphragm 3, the thickness-direction compressibility of the lamination region, among the first lamination region R3 and the second lamination region R4, that is larger in the number of laminated layers and the thickness-direction compressibility of the lamination region, among the first lamination region R3 and the second lamination region R4, that is smaller in the number of laminated layers are different from each other. The first lamination region R3 and the second lamination region R4 may be flush with each other at their boundary on the front and back surfaces of the speaker diaphragm 3. The first lamination region R3 of the speaker diaphragm 3 may have a specific layer structure similar to the specific layer structure of the first lamination region R1 of the speaker diaphragm 1 illustrated in FIG. 1. The second lamination region R4 of the speaker diaphragm 3 may have a specific layer structure similar to the specific layer structure of the second lamination region R2 of the speaker diaphragm 1 illustrated in FIG. 1. The speaker diaphragm 3 may also be similar to the speaker diaphragm 1 illustrated in FIG. 1 in terms of other specific configurations of the speaker diaphragm 3, such as components and thicknesses of the layers of the first lamination region R3 and the second lamination region R4. Each layer of the speaker diaphragm 3 is preferably a chemical fiber-mixed paper layer. Also in the speaker diaphragm 3, it is preferable that the thicknesses of the first lamination region R3 and the second lamination region R4 are uniform.

First Lamination Region

The first lamination region R3 has an annular shape. The first lamination region R3 is formed throughout the inner circumferential edge of the speaker diaphragm 3. The first lamination region R3 includes a plurality of protrusions 3*a*, which protrude outward in the radial direction of the speaker diaphragm 3. The tips of the plurality of protrusions 3*a* extending in the protruding direction do not reach the outer circumferential edge of the speaker diaphragm 3. The plurality of protrusions 3*a* are arranged at equal angular intervals around the center axis of the speaker diaphragm 3. In the speaker diaphragm 3, the first lamination region R3 has the plurality of protrusions 3*a*. This configuration ensures that resonance is dispersed, enabling the speaker diaphragm 3 to generate more natural sound. Also, in the speaker diaphragm 3, the plurality of protrusions 3*a* are arranged at equal angular intervals around the center axis of the speaker diaphragm 3. This configuration ensures that the strength of the neck of the speaker diaphragm 3 is increased substantially uniformly throughout the circumference of the speaker diaphragm 3. The above configuration also makes it easy to equalize the rigidity of the speaker diaphragm 3 and the rigidity of the edge member (not shown) connected to the outer circumferential edge of the speaker diaphragm 3.

Second Lamination Region

The second lamination region R4 includes the outer circumferential edge of the speaker diaphragm 3. More specifically, the second lamination region R4 is formed throughout the outer circumferential edge of the speaker diaphragm 3.

In the speaker diaphragm 3, the number of the layers gradually decreases from the inner side toward the outer side in the radial direction of the speaker diaphragm 3.

Method of Producing Speaker Diaphragm

By a method for producing the speaker diaphragm 3, the speaker diaphragm 3 is produced, in which a plurality of layers are laminated in the thickness direction of the speaker diaphragm 3. This speaker-diaphragm producing method includes a step (forming step) of forming two or more lamination regions different from each other in average density and in the number of laminated layers. Similarly to the case of the speaker diaphragm 1 illustrated in FIG. 1, the forming step includes: a step of wet-forming a paper-making body corresponding to each layer of the speaker diaphragm 3 (paper-making step); a step of laminating the paper-making bodies formed in the paper-making step (laminating step); a step of drying the lamination bodies laminated in the laminating step (drying step); and a step of hot-pressing the lamination bodies dried in the drying step (hot-pressing step).

Advantages

The speaker diaphragm 3 is capable of effectively generating sounds in different frequency bands. Further, by dispersing resonance, the speaker diaphragm 3 is capable of generating more natural sound.

By this speaker-diaphragm producing method, the speaker diaphragm 3 is produced easily and reliably.

Fourth Embodiment

Figure 6:
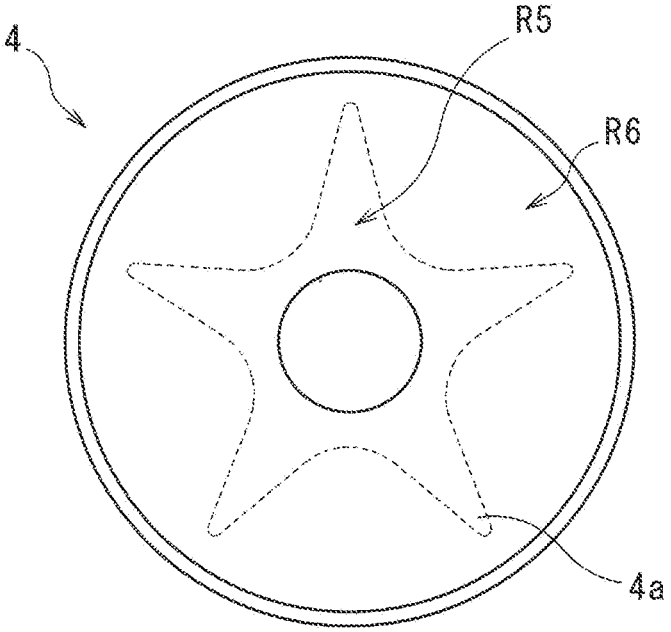
FIG. 6 is a schematic front view of a speaker diaphragm according to an embodiment different from the speaker diaphragms illustrated in FIGS. 1 and 5.

In a speaker diaphragm 4 illustrated in FIG. 6, a plurality of layers are laminated in the thickness direction of the speaker diaphragm 4.

The speaker diaphragm 4 includes two or more lamination regions different from each other in the number of laminated layers. The plurality of lamination regions are continuously aligned in the plane direction of the speaker diaphragm 4. In the speaker diaphragm 4, the lamination regions are different from each other in average density. The plurality of layers are provided from the front surface to the back surface of the speaker diaphragm 4. It is to be noted that the speaker diaphragm 4 may be used for a small-size speaker provided in such devices as a headphone, an earphone, and a portable electronic device.

The speaker diaphragm 4 vibrates in response to an electrical signal. The speaker diaphragm 4 can be formed into a shape corresponding to the speaker in which the speaker diaphragm 1 is used. In FIG. 6, the speaker diaphragm 4 has a cone shape (more specifically, a truncated cone shape). The size of the speaker diaphragm 4 can be set according to the speaker in which the speaker diaphragm 1 is used.

The speaker diaphragm 4 includes: a first lamination region R5 and a second lamination region R5. The first lamination region R5 has a first number of layers. The second lamination region R5 is adjacent to the first lamination region R6 on the radially outer side of the first lamination region R6, and has a second number of layers different from the first number of layers. In the speaker diaphragm 4, the lamination regions, which are different from each other in average density, are different from each other in the number of laminated layers. The relationship between the first lamination region R5 and the second lamination region R6 is the same as the relationship between the first lamination region R3 and the second lamination region R4 described in the third embodiment. In view of this, the relationship between the first lamination region R5 and the second lamination region R6 will not be described here.

First Lamination Region

The first lamination region R5 has an annular shape. The first lamination region R5 includes a plurality of protrusions 4*a*, which protrude outward in the radial direction of first lamination region R5. The tips of the plurality of protrusions 4*a* extending in the protruding direction do not reach the outer circumferential edge of the speaker diaphragm 4. The plurality of protrusions 4*a* are arranged at equal angular intervals around the center axis of the speaker diaphragm 4.

The first lamination region R5 is a star-shaped polygon. This shape ensures that resonance is more easily and reliably dispersed, enabling the speaker diaphragm 4 to generate more natural sound. As used herein, the term "star-shaped polygon" refers to: a shape obtained by extending each side of a polygon and connecting the obtained intersections; and a shape similar to the foregoing shape. Each side may not necessarily be strictly linear. For example, the entirety of each side may be curved in an arch shape in one direction. For another example, each side may be curved or bent at one point or a plurality of points. For still another example, the intersection portion of each side may be rounded. Also, the outline of the "star-shaped polygon" may not necessarily be positioned entirely on the speaker diaphragm; it is possible that a part of the outline is positioned on the speaker diaphragm (that is, a part of the outline may be positioned inside the inner circumferential edge of the speaker diaphragm or outside the outer circumferential edge of the speaker diaphragm).

Second Lamination Region

The second lamination region R6 includes the outer circumferential edge of the speaker diaphragm 4. More specifically, the second lamination region R6 is formed throughout the outer circumferential edge of the speaker diaphragm 4.

In the speaker diaphragm 4, the number of the layers gradually decreases from the inner side toward the outer side in the radial direction of the speaker diaphragm 4.

Method of Producing Speaker Diaphragm

By a method for producing the speaker diaphragm 4, the speaker diaphragm 4 is produced, in which a plurality of layers are laminated in the thickness direction of the speaker diaphragm 4. This speaker-diaphragm producing method includes a step (forming step) of forming two or more lamination regions different from each other in average density and in the number of laminated layers. Similarly to the case of the speaker diaphragm 1 illustrated in FIG. 1, the forming step includes: a step of wet-forming a paper-making body corresponding to each layer of the speaker diaphragm 4 (paper-making step); a step of laminating the paper-making bodies formed in the paper-making step (laminating step); a step of drying the lamination bodies laminated in the laminating step (drying step); and a step of hot-pressing the lamination bodies dried in the drying step (hot-pressing step).

Other Embodiments

It is to be noted that the above-described embodiments are not intended in a limiting sense. It will be readily appreciated that various omissions, substitutions, and additions may be made to the elements described in the above-described embodiments based on the description of the present specification and relevant technical knowledge. It will also be readily appreciated that these omissions, substitutions, and additions are encompassed within the scope of the present disclosure.

For example, the specific layer structure of a speaker diaphragm will not be limited to the specific layer structures described in the above-described embodiments; a speaker diaphragm may include, for example, a layer other than a solid layer and a porous layer. Also, while each layer of the speaker diaphragm is preferably a chemical fiber-mixed paper layer, as described above, the speaker diaphragm may include, for example: a synthetic resin layer containing no fiber; or a pulp layer containing no resin matrix. Further, in the above-described embodiments, the first lamination region and the second lamination region are differentiated based on the presence or absence of a rearmost layer in a region. It is also possible, however, to differentiate a plurality of lamination regions aligned in the radial direction based on the presence or absence of an intermediate layer or a frontmost layer in the thickness direction of the speaker diaphragm. Also, there is no particular limitation to the number of the layers in each lamination region. In addition, the speaker diaphragm may not necessarily have a cone shape. For example, the speaker diaphragm may be a flat plate having any of various shapes such as a polygonal shape, a circular shape, and an irregular shape.

In the above-described embodiments, some layers are common to the adjacent lamination regions. Specifically, the first solid layer 11, the first microporous layer 12, and the second solid layer 13 in the first lamination region R1 and the first solid layer 11, the first microporous layer 12, and the second solid layer 13 in the second lamination region R2 are continuous common layers. However, insofar as at least one layer is a common layer, the other layers may be formed of different materials. Alternatively, insofar as at least one of the layers in the adjacent lamination regions is a common layer, the other layers may be separate from each other regardless of whether the other layers are made of the same or different materials.

In each speaker-diaphragm producing method described above, it is possible to linearly or non-linearly change the thickness of the speaker diaphragm while changing the number of layers from the inner side to the outer side in the radial direction of the speaker diaphragm. This can be made possible by adjusting the molds and/or the pressing method used in the hot-pressing step.

Figure 7:
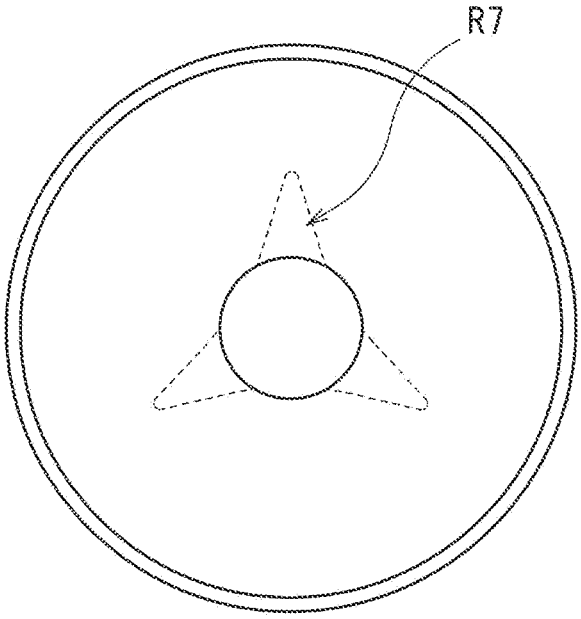
FIG. 7 is a schematic front view of a speaker diaphragm according to an embodiment different from the speaker diaphragms illustrated in FIGS. 1, 5, and 6.

The arrangement of the plurality of lamination regions in the speaker diaphragm will not be limited to the arrangements described in the above-described embodiments. For example, as illustrated in FIG. 7, a first lamination region R7 includes the inner circumferential edge of the speaker diaphragm. In this case, the first lamination region R7 may be provided so as to include a part of the inner circumferential edge of the speaker diaphragm. Also in the speaker diaphragm, the first lamination region may reach the outer circumferential edge of the speaker diaphragm.

Figure 8:
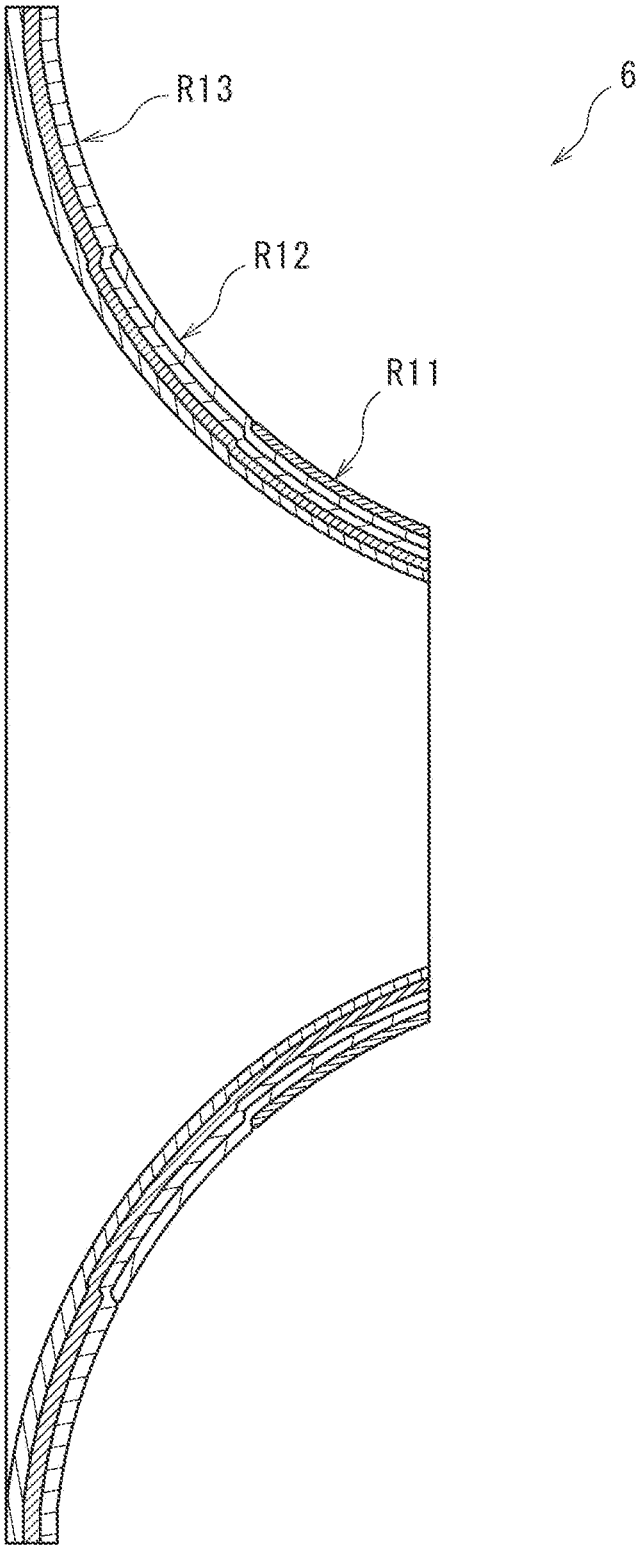
FIG. 8 is a schematic cross-sectional view of a speaker diaphragm according to an embodiment different from the speaker diaphragms illustrated in FIGS. 1, 5, 6, and 7.

The speaker diaphragm may include three or more lamination regions different from each other in the number of laminated layers. A speaker diaphragm 6 illustrated in FIG. 8 includes three lamination regions (a first lamination region (five layers) R11, a second lamination region (four layers) R12, and a third lamination region (three layers) R13) that are different from each other in the number of laminated layers. It is preferable that the first lamination region R11, the second lamination region R22, and the third lamination region R13 at their boundaries are flush with each other on the front and back surfaces of the speaker diaphragm 6. In the speaker diaphragm 6, the number of the laminated layers gradually decreases from the inner side toward the outer side in the radial direction of the speaker diaphragm 6. In the speaker diaphragm 6, the number of the laminated layers decreases stepwise, one by one, from the inner side to the outer side in the radial direction of the speaker diaphragm 6. Because of this configuration, the average density gradually decreases from the inner side to the outer side in the radial direction of the speaker diaphragm 6. The speaker diaphragm 6 can be connected to the edge portion by smoothly changing the average density of the speaker diaphragm 6 from the inner circumferential edge toward the outer circumferential edge of the speaker diaphragm 6.

In the speaker diaphragm, the arrangement of the plurality of lamination regions can be set in accordance with required characteristics. For example, a lamination region having a large number of laminated layers may be located on the outer side in the radial direction of the speaker diaphragm.

A speaker diaphragm may have a configuration in which the average density does not gradually decrease from the inner side toward the outer side in the radial direction of the speaker diaphragm. For example, it is also possible to gradually increase (monotonically in a stepwise manner) the average density from the inner side toward the outer side in the radial direction of the speaker diaphragm by positioning a lamination region having a large number of laminated layers on the outer side in the radial direction of the speaker diaphragm.

In the speaker diaphragm, the average density may increase and decrease from the inner side toward the outer side in the radial direction of the speaker diaphragm. A possible example is that the lamination region including the inner circumferential edge of the speaker diaphragm has four layers, and the number of layers may be changed toward the outer side in the radial direction of the speaker diaphragm such that the next lamination region has three layers and the next lamination region has four layers. In this case, in the speaker diaphragm, the average density of the intermediate region between the inner circumferential edge and the outer circumferential edge can be decreased. Alternatively, the average density of the intermediate region can be increased. Also, the number of layers in adjacent lamination regions may differ by two or more layers.

The speaker diaphragm unit may be configured with the edge member 16 illustrated in FIG. 4 attached to the outer circumferential edge of the speaker diaphragm illustrated in any of FIGS. 5 to 8.

As has been described hereinbefore, each speaker diaphragm according to the present development is capable of generating sounds in a plurality of different frequency bands with a single diaphragm. With this configuration, each speaker diaphragm according to the present development is suitable for speakers having wide frequency reproduction ranges.

In the speaker diaphragm recited in JP11-75290A, when, for example, the rigidity is increased in an attempt to generate a high frequency sound, it becomes difficult to generate a low frequency sound, while when the rigidity is adjusted in an attempt to generate a low frequency sound, it becomes difficult to generate a high frequency sound. That is, in the speaker diaphragm recited in JP11-75290A, the high-frequency sound characteristic and the low-frequency sound characteristic are in a trade-off relationship.

In view of this, a speaker diaphragm according to an embodiment of the present development includes a plurality of layers laminated in a thickness direction of the speaker diaphragm. The speaker diaphragm includes two or more lamination regions different from each other in the number of the laminated layers. The lamination regions are different from each other in average density.

In this speaker diaphragm, a lamination region larger in average density may be larger in the number of the laminated layers than a lamination region smaller in average density.

While an embodiment of the present disclosure and modifications of the embodiments have been described, the embodiments and the modifications are intended as illustrative only and are not intended to limit the scope of the present disclosure. It will be understood that the present disclosure can be embodied in other forms without departing from the scope of the present disclosure, and that other omissions, substitutions, additions, and/or alterations can be made to the embodiments and the modifications. Thus, these embodiments and modifications thereof are intended to be encompassed by the scope of the present disclosure. The scope of the present invention accordingly is to be defined as set forth in the appended claims.

What is claimed is:

1. A speaker diaphragm comprising:

a first lamination region in which a plurality of layers are laminated in a thickness direction of the speaker diaphragm; and a second lamination region in which a plurality of layers different in number from the plurality of layers in the first lamination region are laminated, the second lamination region being different from the first lamination region in average density, wherein the speaker diaphragm has a cone shape, wherein the average density of the first lamination region is a first average density, and the average density of the second lamination region is a second average density, and wherein the second lamination region is adjacent to the first lamination region and disposed on a radially outer side of the first lamination region.

2. The speaker diaphragm according to claim 1, wherein either the first lamination region or the second lamination region that is larger in the average density is larger in the number of the plurality of laminated layers than either the first lamination region or the second lamination region that is smaller in the average density.

3. The speaker diaphragm according to claim 1, wherein at least one of the plurality of layers in the first lamination region or the second lamination region comprises a resin matrix and fibers dispersed in the resin matrix.

4. The speaker diaphragm according to claim 1, wherein the first average density is larger than the second average density.

5. The speaker diaphragm according to claim 1, wherein the first lamination region has an annular shape.

6. The speaker diaphragm according to claim 5, wherein the first lamination region and the second lamination region are concentric regions.

7. The speaker diaphragm according to claim 1, wherein the first lamination region includes a plurality of protrusions protruding outward in a radial direction of the speaker diaphragm.

8. The speaker diaphragm according to claim 1, wherein the speaker diaphragm has an average density that gradually decreases from an inner side of the speaker diaphragm toward an outer side of the speaker diaphragm in a radial direction of the speaker diaphragm.

9. The speaker diaphragm according to claim 1, wherein no step is formed at a boundary between the first lamination region and the second lamination region on an inner surface and an outer surface of the speaker diaphragm.

10. The speaker diaphragm according to 1, wherein the speaker diaphragm has a substantially uniform thickness.

11. The speaker diaphragm according to claim 1, wherein at least one common layer is common to the first lamination region and the second lamination region.

12. The speaker diaphragm according to claim 2, wherein at least one of the plurality of layers in the first lamination region or the second lamination region comprises a resin matrix and fibers dispersed in the resin matrix.

13. A method of producing a speaker diaphragm, the method comprising:

forming a lamination body including a plurality of lamination regions adjacent to each other, the plurality of lamination regions including at least a first lamination region and a second lamination region adjacent to the first lamination region and disposed on a radially outer side of the first lamination region, each of the plurality of lamination regions being formed by laminating a plurality of layers in a thickness direction of the speaker diaphragm, wherein forming the lamination body comprises:

laminating the first lamination region to include a first plurality of layers and having a first average density; and laminating the second lamination region to include a second plurality of layers different in number from the first plurality of layers and having a second average density; and hot-pressing the lamination body to form the lamination body into a cone shape having a substantially uniform thickness, wherein the plurality of lamination regions are different from each other in average density.

14. The method of producing a speaker diaphragm according to claim 13, wherein the plurality of lamination regions are different from each other in a number of the plurality of layers.

15. The method of producing a speaker diaphragm according to claim 13, wherein each of the lamination regions is formed by alternately laminating a solid layer and a porous layer.

* * * * *